US006702727B2

(12) United States Patent
Karsten

(10) Patent No.: US 6,702,727 B2
(45) Date of Patent: Mar. 9, 2004

(54) MULTI-POSITION PAINT ROLLER

(76) Inventor: Samuel Karsten, 11217 Welcome Ave. North, Champlin, MN (US) 55316

( * ) Notice: Subject to any disclaimer, the term of this patent is extended or adjusted under 35 U.S.C. 154(b) by 0 days.

(21) Appl. No.: 10/238,136

(22) Filed: Sep. 10, 2002

(65) Prior Publication Data

US 2003/0009840 A1 Jan. 16, 2003

Related U.S. Application Data

(63) Continuation-in-part of application No. 09/490,417, filed on Jan. 24, 2000, now abandoned, which is a continuation-in-part of application No. 09/041,507, filed on Mar. 12, 1998, now abandoned.

(51) Int. Cl.[7] ..... B05C 1/08

(52) U.S. Cl. ..... 492/19; 492/16; 492/13; 15/230.11

(58) Field of Search ..... 15/230.11, 144.2, 15/144.1; 403/84, 142, 83, 87, 93, 86, 91, 92; 492/13, 16, 19; 29/895.2, 428, 525.01; 81/177.8, 177.9, 489

(56) References Cited

U.S. PATENT DOCUMENTS

| | | | | | |
|---|---|---|---|---|---|
| 8,911 | A | * | 4/1852 | Murrow | 403/71 |
| 69,097 | A | * | 9/1867 | Iske | 403/93 |
| 319,569 | A | | 6/1885 | Ellis et al. | |
| 365,329 | A | | 6/1887 | Cline | |
| 622,428 | A | * | 4/1899 | Harpold | 81/177.8 |
| 858,239 | A | | 6/1907 | Weigert | |
| 1,377,355 | A | | 5/1921 | Knapp | |
| 2,060,262 | A | * | 11/1936 | Stouffer | 81/90.9 |
| 2,310,759 | A | * | 2/1943 | Clawson | 403/93 |
| 2,580,350 | A | | 12/1951 | Friedberg | |
| 2,689,967 | A | * | 9/1954 | Mackey | 15/176.2 |
| 3,273,192 | A | | 9/1966 | Mazzella | |
| 3,375,044 | A | | 3/1968 | Peterson | |
| 3,408,676 | A | | 11/1968 | Cayo | |
| 3,554,659 | A | | 1/1971 | Stokes | |
| 3,568,963 | A | | 3/1971 | Koskinen | |
| 3,866,257 | A | | 2/1975 | Cansdale, Sr. | |
| 4,019,271 | A | * | 4/1977 | Latimer | 40/603 |
| 4,196,491 | A | | 4/1980 | Baril | |
| 4,469,302 | A | * | 9/1984 | Stoudt | 248/512 |
| 4,721,274 | A | | 1/1988 | Erb | |
| 5,207,406 | A | * | 5/1993 | Stine et al. | 248/514 |
| 5,207,755 | A | | 5/1993 | Ampian | |
| 5,692,720 | A | * | 12/1997 | Griggs | 248/530 |
| 6,219,883 | B1 | * | 4/2001 | Keichline | 16/110.1 |
| 2002/0073500 | A1 | * | 6/2002 | Pavlou | 492/13 |

FOREIGN PATENT DOCUMENTS

| | | |
|---|---|---|
| GB | 145952 | 7/1920 |

* cited by examiner

*Primary Examiner*—Gregory Vidovich
*Assistant Examiner*—Marc Jimenez
(74) *Attorney, Agent, or Firm*—Dicke, Billig & Czaja, PLLC

(57) ABSTRACT

A paint roller apparatus for use with a tubular paint applicator including a shaft, a tube-receiving frame, a handle, and a connector. The shaft defines a first end and a second end. The tube-receiving frame is rotatably attached to the second end of the shaft. The handle includes a leading section that defines a plurality of shaft-receiving passages and a bore. The passages are sized to slidably receive the first end of the shaft. The bore extends in a generally perpendicular fashion relative to an axis of each of the passages, intersecting each of the passages. The connector includes a shank sized for placement within the bore. Upon insertion of the first end of the shaft into one of the passages, the shaft is selectively locked relative to the handle via advancement of the shank within the bore.

20 Claims, 6 Drawing Sheets

10
18
20
30
14
28
16
24
26
12
60
62

14
28
42
52
50
48
56
44
54
40
58
46
24
12

MULTI-POSITION PAINT ROLLER

CROSS-REFERENCE TO RELATED APPLICATIONS

This application is a continuation-in-part of U.S. patent application Ser. No. 09/490,417 now abandoned, entitled "Paint Roller with Flexure Joint" and filed Jan. 24, 2000, which is a continuation-in-part of U.S. patent application Ser. No. 09/041,507 now abandoned, entitled "Paint Roller With Flexure Joint" and filed Mar. 12, 1998.

BACKGROUND OF THE INVENTION

The present invention relates to a paint roller. More particularly, it relates to a paint roller adapted to allow selective positioning and repositioning of a tubular paint applicator relative to a handle.

Countless people engage in home-related painting projects on a daily basis. In particular, as part of normal upkeep and/or improvement efforts, interior and exterior walls, floors, ceilings, etc. are often painted and repainted over the course of several years. While the types and colors of paint available have continually evolved, the tools used to apply paint have basically remained the same.

A standard paint brush is a very common tool used to apply a coat of paint to a wall or similar surface. When the surface area to be painted is relatively large, however, the use of a paint brush can be quite time consuming and tiresome. Alternatively, compressed air paint sprayers have more recently been made available. While a paint sprayer is able to distribute a large volume of paint in a relatively short time period, the costs associated with such a device are very high. As a result, while the compressed air paint sprayer can greatly reduce the time required for paint application, it is not a viable alternative to most individuals due to its high costs. Further, it is often times difficult to paint tight spaces with a paint sprayer.

A third, widely available alternative is a hand-held paint roller. The paint roller tool is generally inexpensive, and can be used to apply paint over a large surface area in a relatively short period of time.

Generally speaking, a standard paint roller includes a handle, a U-shaped shaft and a tube receiving frame. One end of the U-shaped shaft extends from the handle. The tube receiving frame is rotatably secured to a second end of the shaft. In this regard, the tube receiving frame is sized to selectively receive and maintain a tubular paint applicator. With this design, prior to use, a user simply inserts a clean tubular paint applicator over the rotatable frame. The tubular paint applicator is then covered with paint. For example, a volume of paint can first be poured into a receptacle, such as a pan. The tubular paint applicator is then dipped into the pan and then rolled back and forth. Once the tubular paint applicator is adequately soaked with paint, the paint roller is used to apply a coating of paint.

Application of paint with the paint roller is a relatively straight forward process. The user grasps the paint roller by the handle and contacts the desired surface with the tubular paint applicator. The handle is pivoted at a slight angle relative to the surface to be painted (and thus relative to the tubular paint applicator) so that the user can maintain constant contact between the surface and tubular paint applicator. Once in this position, the user maneuvers the handle in an up-and-down or back-and-forth motion. Because the tubular paint applicator is rotatably secured to the shaft, the tubular paint applicator rotates along the wall surface in response to movement of the handle by the user. With this configuration, then, the user is then able to rapidly cover a large surface area with a simple up-and-down, or back-and-forth, motion.

The standard paint roller design does address at least one ergonomic concern. Namely, by employing a U-shaped shaft, the standard paint roller design centrally positions the tubular paint applicator perpendicular to an axis of the handle. This orientation allows a user to use a painting motion generally parallel to an axis of the user's forearm. In other words, the user can grasp the handle within his or her palm and then hold the handle at a slight angle relative to the surface being painted. In this way, the user can rotate the tubular paint applicator along the wall surface, yet avoid contact with the wall with his or her hand.

While the U-shaped shaft satisfies one important ergonomic issue, other drawbacks with the standard paint roller design exist. For example, it is virtually impossible to use a paint roller near a corner, such as between a wall and ceiling. Under these circumstances, the user is unable to use the paint roller in the above-described manner. Once again, the U-shaped shaft orientates the tubular paint applicator perpendicular to the handle. Thus, when the handle is grasped in a normal fashion, the tubular paint applicator will be parallel to the corner formed between a wall and ceiling. Because the paint applicator is cylindrical, it is impossible for the tubular paint applicator to contact the wall at the corner without also undesirably contacting the ceiling. The only available solution is for the user to rotate his or her arm and wrist 90 degrees so that an end of the tubular paint applicator fits into the corner being painted. It should be recognized that this positioning of the wrist, arm and shoulder is very uncomfortable and presents a limited range of movement.

An additional concern arises when attempting to paint elevated surfaces. In this scenario, the normal solution is for the user to employ a ladder. Use of a ladder does allow the user to reach elevated surfaces. Unfortunately, however, only a small area can be painted before the user is required to descend and move the ladder. Even if an elongated handle is employed, a distinct problem remains. Namely, because the U-shaped shaft is rigid, it is very difficult for a user to properly orientate the handle when maneuvering the paint roller. In other words, the U-shaped shaft cannot easily be maintained at a large enough angle relative to the wall (or other surface) to provide appropriate leverage to the user. Importantly, this same concern arises in a number of different painting situations. For example, when painting a ceiling, it is often times difficult for the user to provide sufficient force, via the handle, to the tubular paint applicator for adequate paint distribution. Similarly, when painting a high surface with a paint roller having an elongated handle, the user is required to stand extremely close to the wall in question. As a result, because of the minimal angular displacement of the tubular paint applicator and the handle, it is extremely difficult to apply sufficient force to the tubular paint roller.

Paint rollers continue to be cost effective painting tools. However, several drawbacks exist with the standard paint roller design. Therefore, a substantial need exists for a paint roller designed to facilitate natural ergonomic movements for painting high surfaces, ceilings and corners.

SUMMARY OF THE INVENTION

One aspect of the present invention relates to a paint roller apparatus for use with a tubular paint applicator. The apparatus includes a shaft, a tube-receiving frame, a handle, and a connector. The shaft defines a first end and a second end. The tube-receiving frame is rotatably attached to the second end of the shaft. The handle includes a leading section that defines a plurality of shaft-receiving passages and a bore. The passages each extend from a respective opening in the handle, and are sized to slidably receive the first end of the shaft. The bore extends from a side face of the handle in a generally perpendicular fashion relative to an axis of each of the passages. In this regard, the bore intersects each of the passages. Finally, the connector includes a shank sized for placement within the bore. With this in mind, the apparatus is adapted such that upon insertion of the first end of the shaft into one of the passages, the shaft is selectively locked relative to the handle via advancement of the shank within the bore. In one preferred embodiment, three, non-parallel passages are provided.

Another aspect of the present invention relates to a method of assembling a paint roller apparatus. The method includes providing a shaft defining a first end and a second end, with a tube-receiving frame being rotatably attached to the second end. A handle is provided that includes a leading section that defines a plurality of shaft-receiving passages and a bore. The shaft-receiving passages each extend from a respective opening in the handle and are sized to slidably receive the first end of the shaft. The bore extends from a side face of the handle and intersects each of the passages. The first end of the shaft is inserted into one of the passages. The shaft is positioned to a desired rotational orientation relative to the handle. Finally, a portion of a connector is advanced within the bore to lock the shaft relative to the handle.

DETAILED DESCRIPTION OF THE PREFERRED EMBODIMENTS

Figures 1, 2:
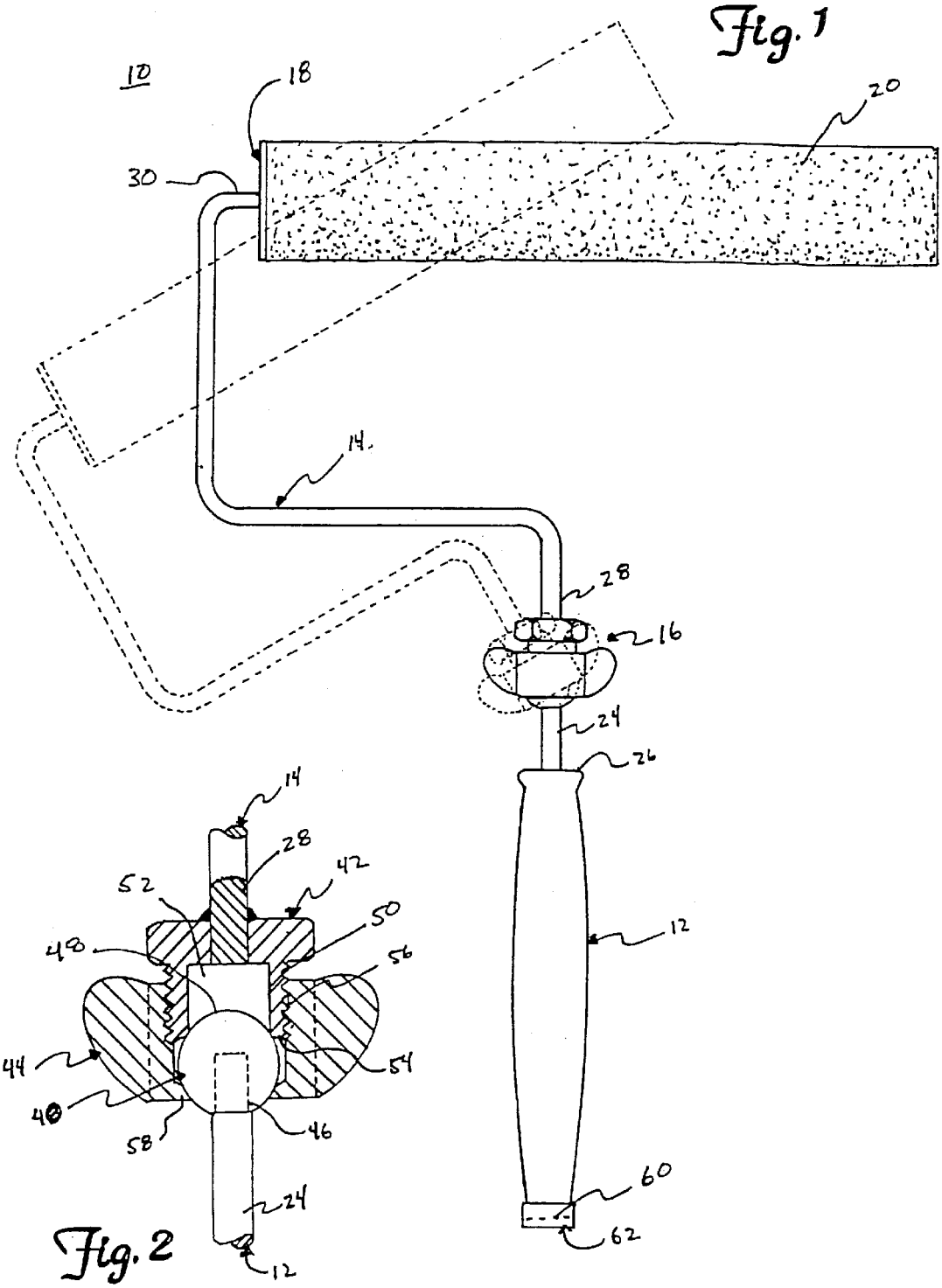
FIG. 1 is a plan view of a paint roller in accordance with the present invention.
FIG. 2 is an enlarged cross sectional view of a flexure joint portion of the paint roller of FIG. 1.

A preferred embodiment of a paint roller 10 is shown in FIG. 1. The paint roller 10 includes a handle 12, a shaft 14, a flexure joint 16 and a tube receiving frame 18. The tube receiving frame 18 is shown in FIG. 1 as being generally encompassed by a tubular paint applicator 20. The handle 12 is selectively secured to an end of the shaft 14 by the flexure joint 16. Further, the tube receiving frame 18 is rotatably secured to an opposite end of the shaft 14.

The handle 12 preferably includes a grip portion 22 and a neck 24. In a preferred embodiment, the grip portion 22 is made of a molded plastic and is sized to rest within a user's hand (not shown). In this regard, the grip portion 22 may include finger articulations for enhancing fit with a user's hand. The neck 24 extends from a leading end 26 of the grip portion 22 and is preferably made of a rigid material, such as stainless steel. The neck 24 terminates at the flexure joint 16. While the grip portion 22 and the neck 24 have been described as separate components, the handle 12 may be integrally formed of a single material. In fact, the neck 24 can be eliminated entirely. Further, the grip portion 22 and the neck 24 may be made from other rigid material, such as aluminum, ceramic, etc.

The shaft 14 forms an approximate U-shape, and includes a first end 28 and a second end 30. The first end 28 is secured to a portion of the flexure joint 16. The second end 30 is rotatably secured to the tube receiving frame 18. The shaft 14 is preferably a rigid rod, formed from a strong material, such as stainless steel. As shown in FIG. 1, the shaft 14 approximates the U-shape associated with a "standard" paint roller design. It should be understood, however, that other shapes and materials, such as plastic or aluminum, are equally acceptable.

The tube receiving frame 18 is of a type commonly known in the art and is rotatably secured to the shaft 14. In this regard, the tube receiving frame 18 may include a ball bearing system (not shown) to provide rotatable association with the shaft 14. Further, the tube receiving frame 18 preferably includes axially extending rods (not shown) sized to frictionally maintain the tubular paint applicator 20.

The flexure joint 16 is configured to provide repositionable orientation of the shaft 14 relative to the handle 12. In one preferred embodiment, as shown in FIG. 2, the flexure joint 16 includes a spherical member 40, a receiving member 42 and a connector 44. In a preferred embodiment, the spherical member 40 is attached to the neck 24 of the handle 12. The receiving member 42, in turn, is secured to the first end 28 of the shaft 14. Finally, the connector 44 is releasably secured to the spherical member 40 and the receiving member 42.

The spherical member 40 is preferably an enlarged stainless steel ball bearing secured to the neck 24. In one preferred embodiment, the spherical member 40 has a diameter of 1 inch, although it should be recognized that other diameters, either greater or smaller, are also available. Further, the spherical member 40 preferably includes an interiorly threaded portion 46 sized to received a similarly threaded portion (not shown) of the neck 24. It should be understood, however, that other materials and forms of attachment are equally acceptable. For example, the spherical member 40 can be welded or otherwise adhered to the neck 24. Alternatively, the interiorly threaded portion 46 may simply be a bore sized to be frictionally received and maintained by the neck 24. Even further, the neck 24 and the spherical member 40 can be integrally formed during manufacture. Regardless of the exact construction, the spherical member 40 provides a circumferential engagement surface 48.

The receiving member 42 preferably includes an exteriorly threaded flange 50, forming an aperture 52. In this regard, a leading end of the flange 50 forms an engagement ring 54. The receiving member 42 is preferably made from a hardened material, such as stainless steel. However, other rigid materials, such as copper, plastic, etc. are acceptable. As should be noted from FIG. 2, a diameter of the aperture 52 formed by the flange 50 is less than a diameter of the spherical member 40. The receiving member 42 is preferably welded to the shaft 14. Alternatively, other forms of attachment, such as an adhesive or a frictional fit, are acceptable.

The connector 44 is preferably a wing nut including a receiving member engagement surface 56 and a spherical member engagement surface 58. The receiving member engagement surface 56 is threaded to threadably engage the exterior threads of the flange 50. In this regard, the receiving member engagement surface 56 has a diameter greater than a diameter of the spherical member 40. Conversely, the spherical member engagement surface 58 generally forms a ring having an inner diameter less than a diameter of a spherical member 40. Thus, the receiving member engagement surface 56 can pass over the spherical member 40. The spherical member engagement surface 58, however, will engage the spherical member 40.

While the connector 44 has been described as preferably being a wing nut to facilitate grasping by a user, other forms are acceptable. For example, the connector 44 can be a generic nut or a spring-loaded clamp configured to selectively engage either the spherical member 40 or the receiving member 42.

The flexure joint 16 is assembled as follows. The connector 44 is axially disposed over the neck 24. The spherical member 40 is then secured to the neck 24. As shown in FIG. 2, then, the connector 44 is now associated with the neck 24 such that it cannot entirely pass over the spherical member 40. The receiving member 42 is secured to the first end 28 of the shaft 14. The connector 44 is then positioned over the neck 24 such that the receiving member engagement surface 56 extends beyond the spherical member 40. The receiving member 42 is threadably secured to the connector 44 via the receiving member engagement surface 56.

More particularly, the connector 44 is rotated relative to the receiving member 42 such that the threaded surfaces engage one another. As the connector 44 further engages the receiving member 42, the flange 50 is directed toward the spherical member 40. This movement is continued until the engagement ring 54 of the receiving member 42 contacts the spherical member 40. As shown in FIG. 2, in this engaged position, a portion of the spherical member 40 extends into the aperture 52 of the receiving member 42. The connector 44 is then tightened to lock the flexure joint 16. In this locked positioned, the spherical member engagement surface 58 of the connector 44 is secured against the spherical member 40. Further, the engagement ring 54 of the receiving member 42 is also secured to the spherical member 40. As a result, the attached shaft 14 and the handle 12 are likewise locked relative to one another.

Position of the shaft 14 relative to the handle 12 can be altered by simply loosening the connector 44. As the connector 44 is at least partially unthreaded from the receiving member 42, the engagement ring 54 of the receiving member 42 is released from the spherical member 40. Likewise, the spherical member engagement surface 58 of the connector 44 is disengaged from the spherical member 40. In this released position, the shaft 14 can be repositioned relative to the neck 24 (and thus the handle 12). Due to the spherical nature of the spherical member 40, the shaft 14 can be maneuvered in virtually any direction relative to the handle 12. As the shaft 14 is maneuvered or rotated relative to the neck 24, the receiving member 42 and the connector 44 move in a similar fashion. Once the shaft 14 is at a second, desired position, the connector 44 is simply tightened relative to the receiving member 42. Once again, this entails rotating the connector 44 relative to the receiving member 42 until the engagement ring 54 and the spherical member engagement surface 58 lock against the spherical member 40.

Returning to FIG. 1, the above-described flexure joint 16 provides for repositioning of the shaft 14 relative to the handle 12 from a first position (shown with continuous lines) to a second position (shown with dashed lines). Because the flexure joint 16 includes the spherical member 40 (FIG. 2), the shaft 14 can be maneuvered to virtually any position along the circumferential engagement surface 48 of the spherical member 40 so long as the connector 44 is able to engage the spherical member 40 as previously described. For example, the shaft 14 can be rotated about a plane parallel to a central axis of the handle 12, or radially about the circumferential engagement surface 48. Thus, while FIG. 1 depicts the second position (dashed lines) as being a counterclockwise (or center-left) movement of the shaft 14 relative to the handle, center-right, center-forward or center-rearward movement and angle in between are also available. This preferred attribute afford a user (not shown) the ability to address a wide variety of painting situations. For example, moving the shaft 14, and thus the attached tubular paint applicator 20, forward relative to the handle 12, a slight forward angular displacement is generated. This forward angular displacement is applicable when painting ceilings, floors, elevated surface, and assists in providing necessary leverage to a user. Further, the shaft 14 can be repositioned radially relative to the handle 12 for corner painting.

While the flexure joint 16 of the preferred embodiment has been shown as being positioned near the grip portion 22 of the handle 12, other locations are equally acceptable. For example, the flexure joint 16 can be positioned along the shaft 14 proximate the tube receiving frame 18. With this configuration, the shaft 14 is essentially defined by two sections; a paint applicator section and a handle section. The handle section of the shaft 14 is essentially an extension of the neck 24. In other words, the neck 24 and the shaft 14 are integrally formed such that the handle section of the shaft 14 is attached to the handle 12. The paint applicator section of the shaft 14 is rotatably secured to the tube receiving frame 18. The flexure joint 16 selectively secures the two sections of the shaft 14 as previously described. In other words, at least a portion of the shaft 14, and thus the tube receiving frame 18, is repositionable relative to the handle 12.

While the flexure joint 16 has been preferably described as including the spherical member 40, the receiving member 42 and the connector 44, other repositionable attachment means are acceptable. For example, the spherical member 40 may be attached to the shaft 14, whereas the receiving member 42 is associated with the handle 12. Even further, an entirely different attachment means can be provided. For example, the attachment means 16 may include a spring actuated lever positioned to provide for a locked, repositionable orientation of the shaft 14 relative to the handle 12. Even further, a ratchet-type assembly or a pin retention system can be used. Regardless of the specific design, the attachment means 16 is configured to provide a user with the ability to selectively change position of the tube receiving frame 18 (and thus an attached tubular paint applicator 20) relative to the handle 12 via movement of at least a portion of the shaft 14. The attachment means 16 is simply configured to selectively lock the paint roller 10 in a desired position regardless of whether a round, square or any other shaped component is used. Importantly, it is not necessary that the attachment means 16 provide the degrees of freedom offered by the preferred embodiment. In other words, the attachment means 16 need only be configured to allow one degree of freedom for many applications.

In another alternative embodiment, the handle 12 includes a receiving means 60 positioned at a trailing end 62 of the handle 12. The receiving means 60 is configured to receive and engage a portion of an extension device (not shown). The extension device may be an elongated rod or other apparatus used to effectively extend a length of the handle 12 for a user. In one embodiment, the receiving means 60 is an interiorly threaded bore sized to threadably receive an exteriorly threaded end of the extension device. Alternatively, a friction fit or other engagement approach may be used.

Figure 3:
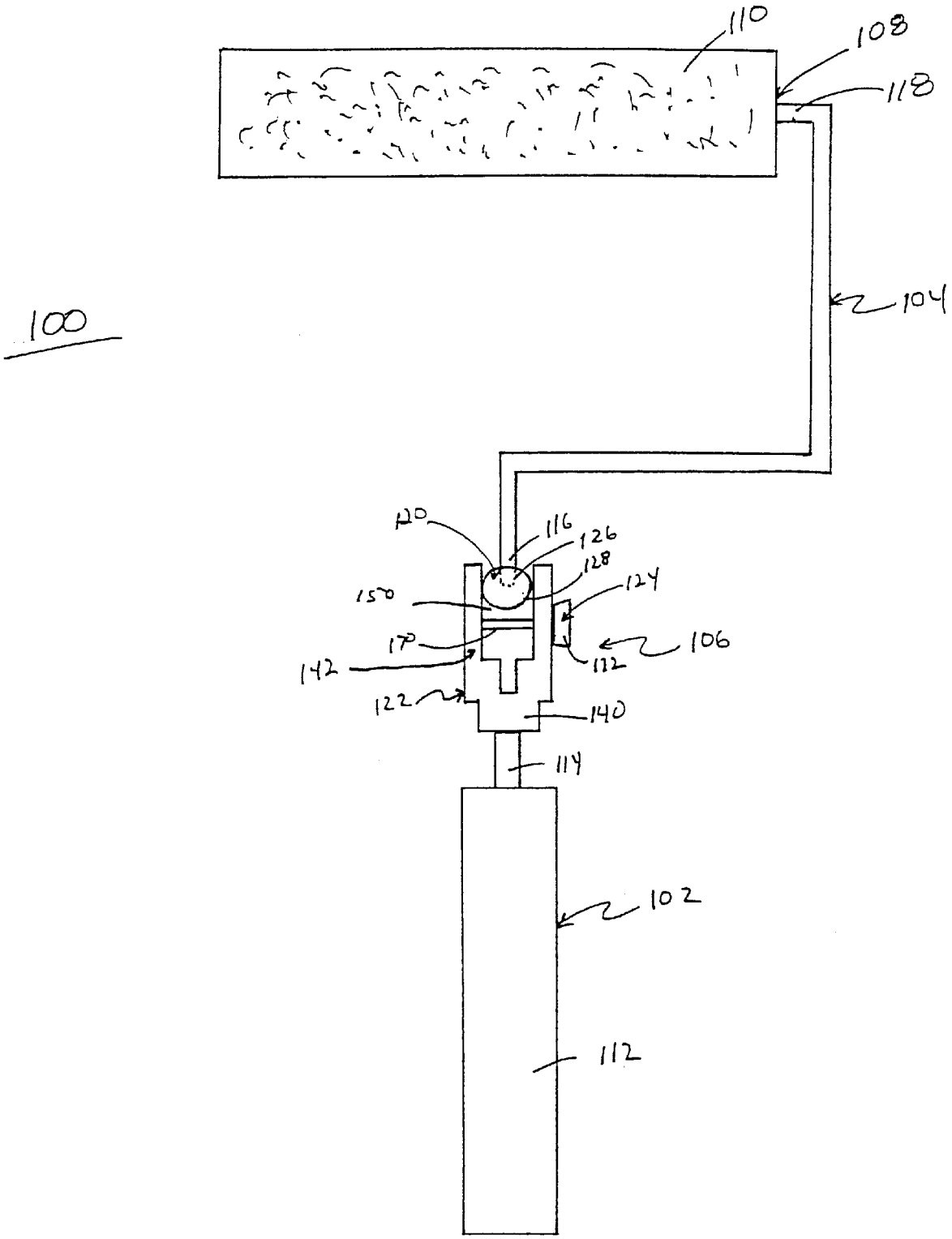
FIG. 3 is a plan view of an alternative paint roller in accordance with the present invention.

Another alternative embodiment of a paint roller 100 is shown in FIG. 3. As with previous embodiments, the paint roller 100 includes a handle 102, a shaft 104, a flexure joint 106 and a tube receiving frame 108. The tube receiving frame 108 is shown in FIG. 3 as being generally encompassed by a tubular paint applicator 110. The handle 102 is selectively secured to an end of the shaft 104 by the flexure joint 106. Further, the tube receiving frame 108 is rotatably secured to an opposite end of the shaft 104.

The handle 102 is preferably similar to the handle 12 (FIG. 1) previously described. Thus, in a preferred embodiment, the handle 102 includes a grip portion 112 and a neck 114, with the neck 114 terminating at the flexure joint 106. Alternatively, other shapes, configurations and/or constructions known in the art can be employed.

The shaft 104 is likewise preferably similar to the shaft 14 (FIG. 1) previously described, preferably forming an approximate U-shape and including a first end 116 and a second end 118. The first end 116 is preferably secured to a portion of the flexure joint 106, whereas the second end 118 is preferably secured to the tube receiving frame 108. Alternatively, other shapes, configurations and/or constructions know in the art can be employed.

The tube receiving frame 108 is preferably similar to the tube receiving frame 18 (FIG. 1) previously described. In this regard, the tube receiving frame 108 is preferably rotatably secured to the shaft 104.

The flexure joint 106 is, similar to the flexure joint 16 (FIG. 2) previously described, configured to provide for a repositionable, "locked" orientation of the shaft 104 relative to the handle 102. The flexure joint 106 includes a spherical member 120, a receiving member 122 and a connector 124. In one preferred embodiment, the spherical member 120 is attached to the first end 116 of the shaft 104, whereas the receiving member 122 is attached to the neck 114 of the handle 102. Alternatively, location of the spherical member 120 and the receiving member 122 can be reversed. Regardless, the connector 124 is connected to the receiving member 122 to releasably secure the spherical member 120 to the receiving member 122.

The spherical member 120 is preferably similar to the spherical member 40 (FIG. 2) previously described. In one preferred embodiment, the spherical member 120 is a stainless steel ball bearing having a diameter of approximately 0.687 inch, although other materials and diameters are equally acceptable. Further, the spherical member 120 preferably forms a bore 126 for facilitating attachment to the first end 116 of the shaft 104, such as by a weld. Alternatively, other attachment techniques known in the art, such as threading, adhesives, frictional fit, etc., are equally acceptable. Even further, the spherical member 120 and the shaft 104 (or, in accordance with an alternative embodiment, the spherical member 120 and the neck 114 of the handle 102) can be integrally formed. Regardless, the spherical member 120 provides a circumferential engagement surface 128.

Figure 4A:
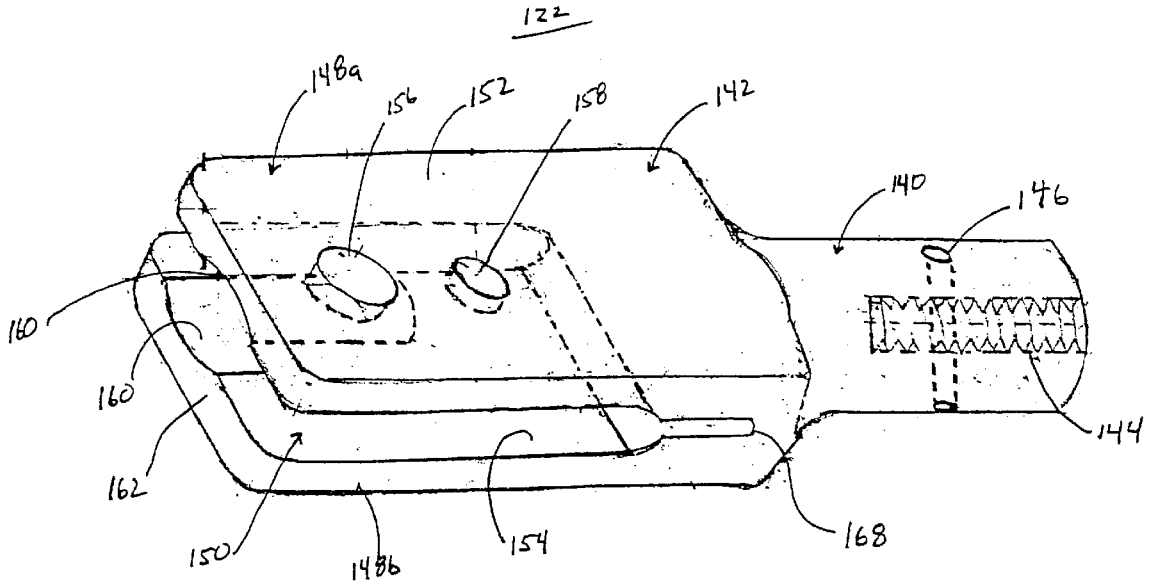
FIG. 4A is a perspective view of flexure joint portion of the paint roller of FIG. 3.
Figure 4B:
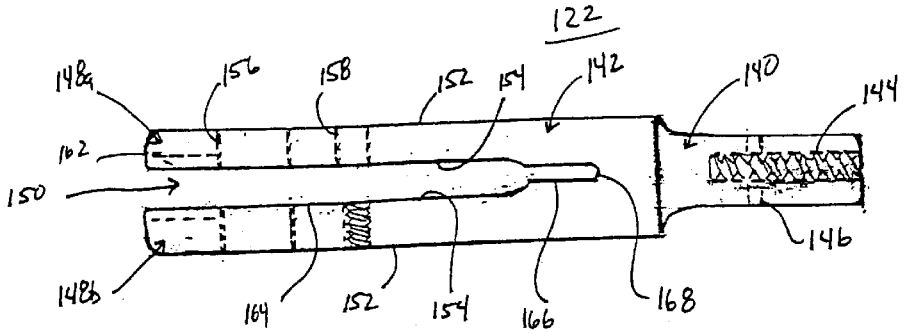
FIG. 4B is a cross-sectional view of the flexure joint of FIG. 4A.

The receiving member 122 is shown in greater detail in FIGS. 4A and 4B. In a preferred embodiment, the receiving member 122 is generally Y-shaped, defined by a shoulder 140 and a clamp 142. The clamp 142 extends in a substantially uniform fashion from the shoulder 140.

The shoulder 140 is preferably configured for attachment to the neck 114 (FIG. 3), forming a longitudinal bore 144 and a transverse pin passage 146. The longitudinal bore 144 is sized to receive the neck 114, and can be interiorly threaded to promote a more complete engagement with the neck 114. The transverse pin passage 146 extends through the longitudinal bore 144 and is sized to receive and frictionally maintain a roll pin (not shown). The roll pin effectively affixes the neck 114 to the shoulder 140. Alternatively, the shoulder 140 can be configured for other forms of attachment to the neck 114 (or, in an alternative embodiment, to the shaft 104 (FIG. 3)), such as by a weld, adhesive, etc. With these alternative configurations, one or more of the longitudinal bore 144 and the transverse pin passage 146 can be eliminated.

The clamp 142 includes opposing flanges or arms 148*a*, 148*b* separated by a longitudinal slot 150. In this regard, the opposing arms 148*a*, 148*b* preferably extend in a substantially identical fashion from the shoulder 140. Each of the opposing arms 148*a*, 148*b* forms an outer surface 152, an inner surface 154 (defined by the slot 150), a ball receiving groove 156 and a connector receiving passage 158. The ball receiving grooves 156 are aligned with one another. Likewise, the connector receiving passages 158 are also aligned with one another, with the ball receiving grooves 156 being spaced distally from the connector receiving passages 158 (relative to the orientations of FIGS. 3, 4A and 4B).

The opposing arms 148*a*, 148*b* are preferably formed such that the outer surfaces 152, respectively, are substantially flat, having a width in the range of 0.5–1.5 inches; more preferably in the range of 0.75–1.25 inches; most preferably approximately 1 inch. The inner surfaces 154, respectively, are substantially flat, forming a concave channel 160 in one preferred embodiment. The concave channels 160 are preferably identical, each extending from a leading end 162 of the clamp 142 to at least the respective ball receiving groove 156. The concave channels 160 are sized in accordance with a diameter of the spherical member 120 (FIG. 3) so as to facilitate initial assembly of the spherical member 120 to the receiving member 122, as described in greater detail below. Thus, in one preferred embodiment, a spacing of the inner surfaces 154 of the opposing arms 148*a*, 148*b* (or height of the slot 150) is smaller than a diameter of the spherical member 120, except in the region of the concave channels 160 whereby the spacing approximates, or is only slightly smaller than, a diameter of the spherical member 120. As a result, the spherical member 120 can relatively easily slide along the concave channels 160 into engagement with the ball receiving grooves 156. Alternatively, with other assembly techniques, the concave channels 160 need not be formed.

As depicted in FIGS. 4A and 4B, the slot 150 is elongated, extending proximally from the leading end 162 of the clamp 142 and preferably defining a first region 164 and a second region 166. A height of the first region 164 is preferably greater than a height of the second region 166. That is to say, the slot 150 is preferably formed such that a spacing between the opposing arms 148*a*, 148*b* is greater along the first region 164 than the second region 166. With this configuration, the first region 164 preferably extends proximally beyond at least the connector receiving passages 158, respectively. The height of the first region 164 (or spacing between the opposing arms 148*a*, 148*b*) corresponds with a diameter of the spherical member 120 (FIG. 3) as well as a thickness of the shaft 104 (FIG. 3). More particularly, the height of the first region 164 is preferably less than a diameter of the spherical member 120 such that the spherical member 120 is retainable between the opposing arms 148*a*, 148*b*, in a labeled position as described below. Further, to facilitate a wide range of motion of the shaft 104 relative to the handle 102 (FIG. 3), the height of the first region 164 (especially in a locked position of the clamp 142) is preferably greater than a thickness of the shaft 104. In other words, as described in greater detail below, the first region 164 is sized to allow passage of the shaft 104 within the first region 164. With these preferred constraints in mind, in one preferred embodiment where the spherical member 120 has a diameter of approximately 0.687 inch and the shaft 104 has a thickness or diameter of approximately 0.375 inch, the height of the first region 164 is approximately 0.4 inch. Alternatively, other heights or spacings are equally acceptable.

As described below, incorporation of the slot 150 allows the opposing arms 148*a*, 148*b* to slightly deflect toward or away from one another to engage or release the spherical member 120 (FIG. 3). By forming the slot 150 to be elongated (in a longitudinal direction), the opposing arms 148*a*, 148*b* are more easily deflectable at a trailing end 168 of the slot 150. Thus, by forming the slot 150 to further include the second region 166, an overall length of the slot 150 is increased. However, in a preferred embodiment, the second region 166 has a height (or spacing between the opposing arms 148*a*, 148*b*) that is less than the first region 164, with the second region 166 terminating at the trailing end 168. With this preferred configuration, the desired, relatively easy deflection characteristic is achieved, with the opposing arms 148*a*, 148*b* pivoting relative to one another at the trailing end 168. Further, an overall strength of the clamp 142 is enhanced. That is to say, the opposing arms 148*a*, 148*b* are preferably thicker in the area of the second region 166, and in particular the trailing end 168, such that the clamp 142 is less likely to fail over time. Alternatively, however, the slot 150 can be formed to have a relatively uniform height.

The ball receiving grooves 156 are formed transverse to the slot 150, and are configured to receive and maintain the spherical member 120 (FIG. 3). In one preferred embodiment, for ease of manufacture, the ball receiving grooves 156 are bores extending through the respective opposing arm 148*a*, 148*b*. Alternatively, the ball receiving grooves 156 need not extend through the respective arm 148*a*, 148*b*, instead being formed at the respective inner surface 154. Regardless, the ball receiving grooves 156 are sized to be slightly smaller than a diameter of the spherical member 120 such that the spherical member 120 is retainable within each of the ball receiving grooves 156. For example, in accordance with a preferred embodiment whereby the spherical member has a diameter of approximately 0.687 inch, each of the ball receiving grooves preferably defines a diameter of approximately 0.5 inch. Alternatively, other dimensions are equally acceptable. Regardless, the ball receiving grooves 156 are configured to engage the spherical member 120 in a locked position, as well as to generally retain while allowing rotation of the spherical member 120 in virtually any direction in an unlocked position.

The connector receiving passages 158 are spaced from the ball receiving grooves 156, and are configure to selectively retain the connector 124 (FIG. 3). For example, in one preferred embodiment, the connector receiving passage 158 associated with the arm 148*a* provides clearance about a portion of the connector, whereas the connector receiving passage 158 associated with the arm 148*b* is interiorly threaded for threadably engaging a corresponding portion of the connector 124. Alternatively, other attachment configuration are equally acceptable. Regardless, the connector receiving passages 158 are preferably spaced (longitudinally) from the ball receiving grooves a sufficient distance to allow clearance from the spherical member 120 (FIG. 3) upon final assembly, but close enough to provide an appropriate clamping force. As described below, the connector 124 will force the opposing arms 148*a*, 148*b* toward one another to secure the spherical member 120 in a locked position. By positioning the connector receiving passages 158 in relative close proximity to the ball receiving grooves 156, the clamping force provided by the connector 124 will relatively rigidly maintain the spherical member 120 within the clamp 142 in a locked position. For example, in one preferred embodiment, a center of the connector receiving passages 158 is spaced from a center of the ball receiving grooves 156 by approximately 0.625 inch, although other dimensions are equally acceptable.

In a preferred embodiment, the shoulder 140 and the clamp 142 are integrally formed from a high strength material, preferably T6 aluminum. Alternatively, other high strength materials, such as metals or metal alloys, plastic, ceramic, etc., are also acceptable.

Returning to FIG. 3, the connector 124 is preferably a bolt, including a shank 170 and a head 172. The shank 170 is sized to preferably configure through one of the connector receiving passage 158 (FIG. 4B) and threadably engage the other connector receiving passage 158 (FIG. 4B) as previously described. Conversely, the head 172 has a width greater than the connector receiving passages 158 such that head 172 will abut the outer surface 152 of the arm 148*a*. Alternatively, the connector 124 can assume other configurations known in the art.

With additional reference to FIGS. 4A and 4B, the flexure joint 106 is assembled by disconnecting the connector 124. The spherical member 120 is placed into engagement with the receiving member 122. More particularly, the spherical member 120 is aligned with the clamp 142 at the leading end 162, and then slid along the concave channels 160 into contact with the ball receiving grooves 156. Notably, the opposing arms 148*a*, 148*b* will deflect slightly at the trailing end 168 of the slot 150 to allow passage of the spherical member 120. The circumferential surface 128 of the spherical member 120 is thereby retained within the ball receiving groove 156 in this unlocked position such that the spherical member 120 will not easily disengage the ball receiving grooves (due to a light clamping force of the opposing arms 148*a*, 158*b*, but can easily rotate within the ball receiving grooves 156.

Once the spherical member 120 is inserted within the ball receiving grooves 156, the connector 124 is tightened relative to the clamp 142, forcing the opposing arms 148*a*, 148*b* toward one another. This tightening action effectively "locks" the spherical member between the opposing arms 148*a*, 148*b* at the ball receiving grooves 156 in an engaged or locked position. As a result, the shaft 104 and the handle 102 are likewise locked to one another.

Figure 5:
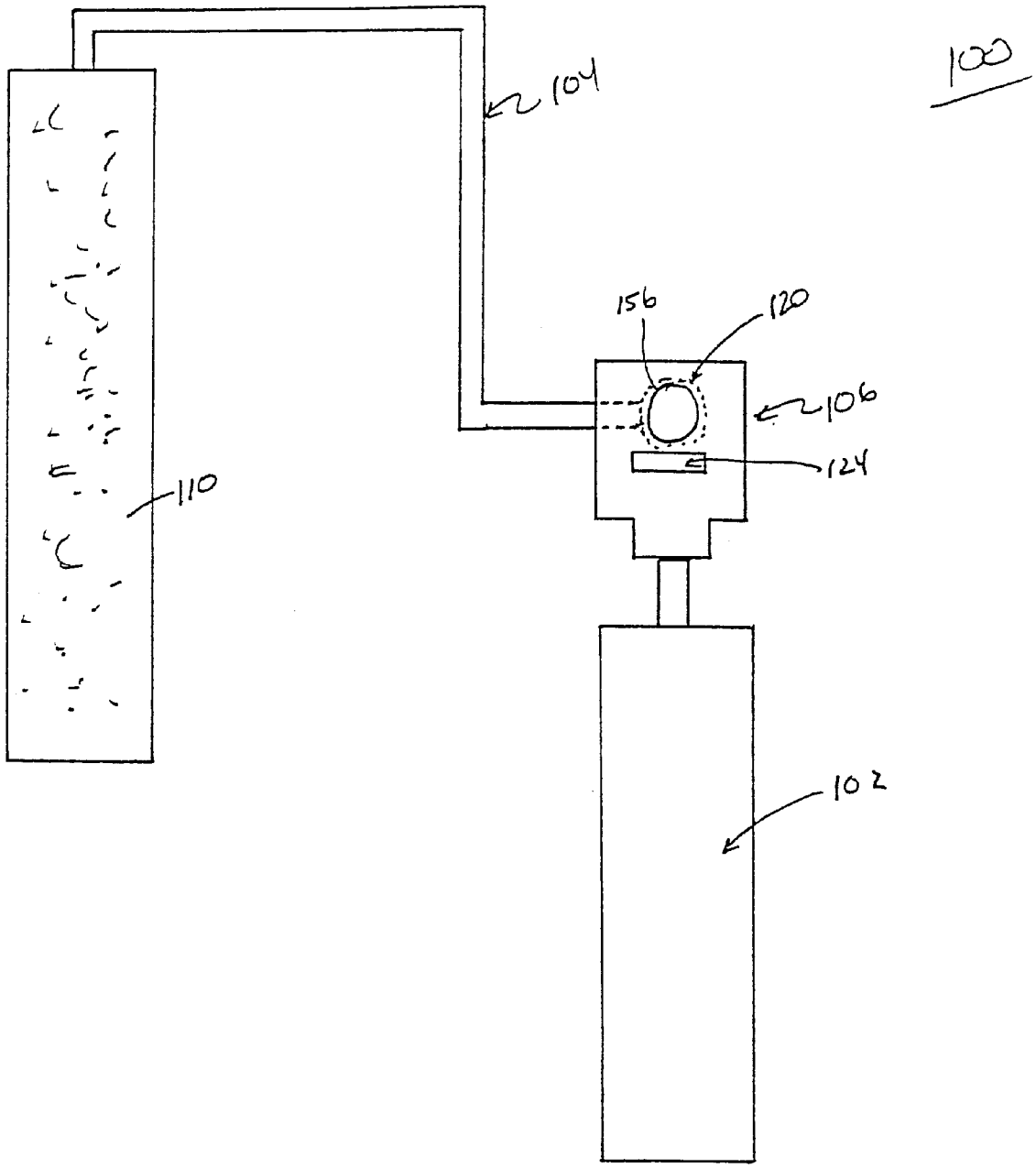
FIG. 5 is a plan view of the paint roller of FIG. 3 in an angularly displaced orientation.

Orientation and positioning of the shaft 104 relative to the handle 102 can be altered by simply loosening the connector 124. As the connector 124 is at least partially loosened, the opposing arms 148*a*, 148*b* disengage or partially release the spherical member 120. Preferably, however, the spherical member 120 remains within the ball receiving grooves 156 so that a general assembly of the flexure joint 106 remains intact. Once the clamping force imparted by the opposing arms 148*a*, 148*b* is decreased, the shaft 104 can be rotated to any position about a central axis A defined by the first end 116 of the shaft 104/spherical member 120. In addition, and with reference to FIG. 5, the shaft 104 can be rotated or angularly displaced in a sideways fashion about an axis (into the sheet of FIG. 5) perpendicular to the central axis A. In other words, with reference to the orientation of FIG. 5, the shaft 104 can be rotated clockwise or counterclockwise, centered at the spherical member 120, otherwise maintained generally within the ball receiving grooves 156. To this end, the receiving member 122 does not overly inhibit angular displacement or rotation of the shaft 104. More particularly, by forming the slot 150 (FIG. 3) to have a height (or spacing between the opposing arms 148*a*, 148*b*) greater than a width or thickness of the shaft 104, the shaft 104 can pass within the receiving member 122 as shown in FIG. 5. Effectively, then, with reference to the orientation of FIG. 5, the shaft 104 can be angularly displaced clockwise or counterclockwise until the shaft contacts a lower section of the receiving member 122. With this configuration, the flexure joint 106 permits a wide range of angular displacement of the shaft 104 relative to the handle 102. For example, with reference to the "upright" orientation of FIG. 3, the flexure joint 106 allows the shaft 104 to be angularly displaced relative to the handle 102 by at least 30 degrees, more preferably by at least 60 degrees, even more preferably by at least 90 degrees (as shown in FIG. 5), and most preferably by at least 135 degrees. Notably, the shaft 104 can be further rotated along the central axis C at any clockwise or counterclockwise angular position of the shaft 104. Thus, the flexure joint 106 effectively provides two degrees of freedom of movement.

Once the shaft 104 (and thus the tubular paint applicator 110) is located in a desired angular and rotational position relative to the handle 102, the connector 124 is tightened so as to lock the spherical member 120 within the clamp 142. The paint roller 100 is then available for use. Subsequently, depending upon the particular painting application, the connector 124 can be loosened, and the shaft 104 (and thus the tubular paint applicator 110) maneuvered to a third angular and rotational position relative to the handle.

Figure 6:
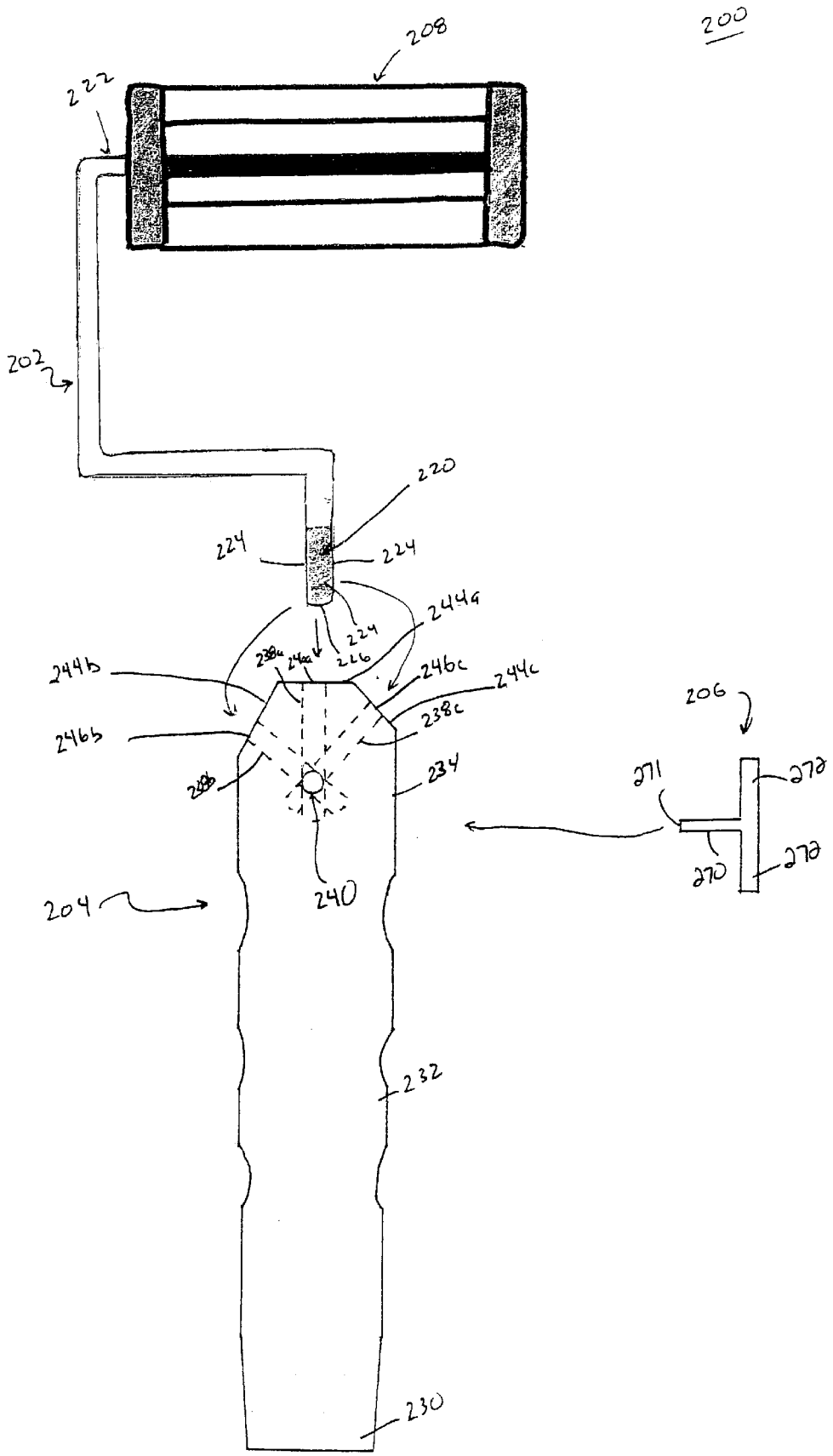
FIG. 6 is an exploded, plan view of a paint roller apparatus in accordance with the present invention.

An alternative preferred embodiment paint roller apparatus 200 is shown in FIG. 6. The paint roller 200 includes a shaft 202, a handle 204, a connector 206, and a frame 208. Details on the various components are provided below. In general terms, however, the frame 208 is rotatably secured to the shaft 202 and is adapted to receive a tubular paint applicator (similar to the tubular paint applicator 20 of FIG. 1). An opposite end of the shaft 202 is connectable to the handle 204, with the connector 206 selectively locking the shaft 202 relative to the handle 204 in a desired angular orientation and rotational position.

As with previous embodiments, the shaft 202 forms an approximate U-shape, and includes a first end 220 and a second end 222. The frame 208 is rotatably secured to the second end 222. The first end 220, however, is adapted to be slidably received within a passage provided by the handle 204, as described in greater detail before. Further, the first end 220 provides a plurality of flattened surfaces 224 (referenced generally in FIG. 6) that facilitates locked engagement with the connector 206. That is to say, the first end 220 is preferably not rounded (or circular in cross-section), with the flattened surfaces 224 providing sufficient surface area for engaging contact with a portion of the connector 206, as described below.

In one preferred embodiment, the first end 220 defines a square in transverse cross-section, such that four of the flattened surfaces 224 are provided, three of which (224*a*–224*c*) are identified in FIG. 6. Alternatively, the first end 220 can be configured to provide more or less of the flattened surfaces 224, such as by being triangular, octagonal, etc., in transverse cross-section. Regardless, each of the flattened surfaces 224 are identical, having a preferred length (relative to a tip 226 of the first end 220) in the range of 0.5–1 inch, more preferably 0.75 inch. In a most preferred embodiment, the first end 220 is a squared body having a length and width of 0.25 inch. In conjunction with the handle 204 and the connector 206 described below, it has been surprisingly found that a 0.25 inch squared body having a length of 0.75 inch provides adequate surface area for engagement by the connector 206 to achieve a desired locked orientation.

The handle 204 includes a trailing section 230, an intermediate section 232, and a leading section 234. Similar to previous embodiments, the trailing section 230 is preferably configured to receive and engage a portion of an extension device (not shown), such as by an interiorly threaded bore (not shown). Similarly, the intermediate section 232 preferably includes finger articulations 236 adapted for enhancing a fit within a user's hand.

The leading section 234 is adapted to selectively receive and maintain the first end 220 of the shaft 202 via a plurality of shaft-receiving passages 238 (referenced generally in FIG. 6) and a bore 240. Each of the passages 238 are sized to slidably receive the first end 220 of the shaft 202. The bore 240 is sized to receive a portion of the connector 206 and intersects each of the passages 238.

Each of the passages 238 preferably extend in a non-parallel fashion relative to each other. The varying angular orientation of each of the passages 238 provide a corresponding, varying angular orientation of the shaft 202 relative to the handle 204 upon final assembly. For example, in one preferred embodiment, three of the passages 238 are provided, with a first passage 238*a* extending parallel with a central axis H of the handle 204. A second one of the passages 238*b* extends in an angular fashion relative to the handle axis H, preferably defining an angle of approximately 60° (±5°) relative to the handle axis H. A third one of the passages 238*c* also extends at an angular fashion relative to the handle axis H, preferably at a differing angle. More particular, in one preferred embodiment, the third passage 238*c* defines an angle of approximately 30° (±5°) relative to the handle axis H. Other angular orientations of the passages 238*a*–238*c* can also be employed.

In conjunction with the above-described positioning of the passages 238 relative to the handle axis H, the leading section 234 is further preferably configured to facilitate easy identification of the resultant shaft 202/handle 204 positioning upon final assembly via a top surface 242 thereof. With the preferred embodiment of three of the passages 238*a*–238*c*, the top surface 232 is preferably configured to define first, second, and third top surface portions 244*a*, 244*b*, 244*c*, respectively. The first passage 238*a* extends from an opening 246*a* in the first top surface portion 244*a*. Similarly, the second passage 238*b* extends from an opening 246*b* in the second top surface portion 244*b*. Finally, the third passage 238*c* extends from an opening 246*c* in the third top surface portion 244*c*. The top surface portions 244*a*–244*c* are preferably oriented such that the corresponding passage 238*a* –238*c* extends in a generally perpendicular fashion relative to a plane defined by the respective top surface portion 244*a* –244*c*. With this in mind, and in one preferred embodiment, then, the second top surface portion 244*b* extends from the first top surface portion 244*a* at an angle that is different from an extension of the third top surface portion 244*c* relative to the first top surface portion 244*a*. For example, in one preferred embodiment, the first and second top surface portions 244*a*, 244*b* define an angle of approximately 240° (±5°), whereas the first and third top surface portions 244*a*, 244*c* combine to define an angle of approximately 210° (±5°). Again, other angular extensions are acceptable. Regardless, a user can quickly discern by simply viewing a relationship of the second or third top surface portions 244*b*, 244*c* relative to the first top surface portion 244*a* as to what the final angular orientation of the shaft 202 relative to the handle 204 will be upon final assembly. The angular orientation of the second top surface portion 244*b* relative to the first top surface portion 244*a* is illustrated in greater detail in FIG. 7.

In one preferred embodiment, each of the passages 238 are co-planar. Alternatively, one or more of the passages 238 can be offset relative to others of the passages 238.

Figure 7:
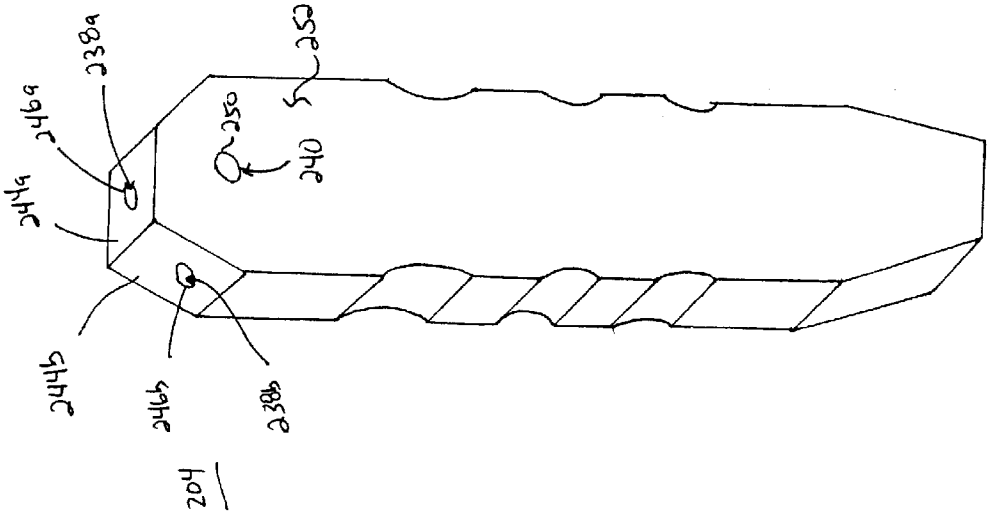
FIG. 7 is a side, perspective view of a handle portion of FIG. 6.

As previously described, the bore 240 is positioned and extends in a manner so as to intersect with each of the shaft-receiving passages 238. As shown in FIG. 7, and in one preferred embodiment, the bore 240 extends from an opening 250 formed in a side face 252 of the leading section 234. By intersecting each of the passages 238, the bore 240 facilitates locking of the shaft 202 relative to the handle 204, with the first end 220 placed in one of the passages 238 via the connector 206. In this regard, the bore 240 preferably extends in a substantially perpendicular fashion (i.e., ±5°) relative to an axis of each of the passages 238.

The bore 240 is preferably centered relative to opposing side faces 252*a*, 252*b* of the leading section 234 as shown in FIG. 6. Further, the bore 240 is preferably positioned a sufficient distance below the first top surface portion 244*a* to ensure that a sufficient length of the first end 220 of the shaft 202 is inserted within the first passage 238*a* upon final assembly. By way of reference, each of the passages preferably has a depth of approximately 1 inch. This preferred depth, in conjunction with a preferred location of the bore 240 has surprisingly been found to provide sufficient surface area engagement between the handle 204 and the shaft 202 in the locked state as a relatively lengthy portion of the shaft 202 is supported within the handle 204. In one preferred embodiment, the bore 240 is positioned approximately 0.5625 inch below the first top surface portion 244*a*.

Figure 8:
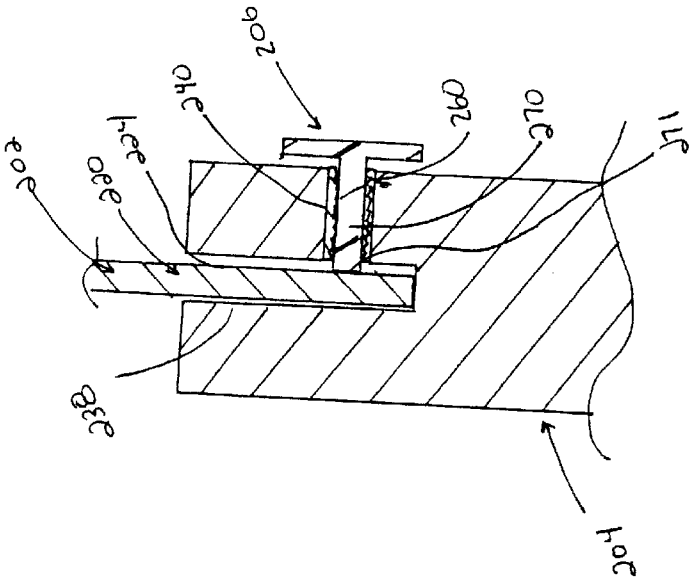
FIG. 8 is an enlarged, cross-sectional view of a portion of the paint roller of FIG. 6 upon final assembly.

The bore 240 is preferably interiorly threaded to facilitate coupling with the connector 206. In this regard, the handle 204 can be manufactured to define the internal threads. Alternatively, a threaded metal insert 260 can be press fitted within the bore 240 as shown in FIG. 8. Regardless, the bore 240 and/or the insert 260 has a sufficient length to ensure adequate threaded interaction with the connector 206. Thus, in one preferred embodiment, the bore 240 has a length of approximately 0.3125 inch, although other dimensions are acceptable.

Returning to FIG. 6, the connector 206 includes a shank 270 terminating in a tip 271. In conjunction with the preferred threading of the bore 240 and/or the threaded insert 260, the shank 270 preferably forms exterior threads sized to threadably engage the bore 240 or the threaded insert 260. The tip 271 is preferably flat, and defines an engagement end of the connector 206. In one preferred embodiment, the connector 206 is a wing nut that defines finger extensions 272. Alternatively, other connectors known in the art are equally acceptable.

During use, the first end 220 of the shaft 202 is inserted into a selected one of the passages 238. In this regard, a desired rotational orientation of the shaft 202 relative to the handle 204 can be determined prior to insertion of the first end 220. Alternatively, the passages 238 can be configured to allow rotation of the first end 220 about an axis thereof following insertion (e.g., the passages 238 are circular in cross-section). Conversely, the passages 238 can be configured in accordance with a shape of the first end 220 such that a limited number of rotational positions are available when initially inserting the first end 220 (e.g., the first end 220 and the passages 238 are square in transverse cross-section).

Regardless, the first end 220 is fully inserted within the selected passage 238. The connector 206 is then used to lock the shaft 202 relative to the handle 204. In particular, and in one preferred embodiment, the connector 206 is maneuvered relative to the handle 204 such that the shank 270, and in particular the tip or engagement end 271 is advanced within the bore 240. For example, where the shank 270 is threadably secured within the bore 240, the connector 206 is rotated in an appropriate direction to effectuate advancement within the bore 240. Movement of the connector 206 continues until the engagement end 271 contacts the first end 220 of the shaft 202 (otherwise inserted within the desired passage 238). In this regard, the preferred flattened surfaces 224 formed by the first end 220 provide a relatively large surface area for enhanced contact with the preferably flat tip 271 of the connector 206. In one of the flattened surfaces is not fully aligned with the tip 271, advancement of the shank 270 causes the first end 220 to rotate slightly within the passage 238 until a flattened surface 224 is aligned with the tip 271. The connector 206 is then tightened, thereby locking the shaft 202 relative to the handle 204.

As should be evident from the above, the paint roller 200 provides for a number of different shaft 202/handle 204 angular orientations and rotational positions. With the one preferred embodiment in which three of the shaft-receiving passage 238*a*–238*c* are provided and the first end 220 of the shaft 202 is square in transverse cross-section, the paint roller 200 provides for twelve possible angular/rotational positions of the shaft 202 relative to the handle 204. By having the bore 240 intersect each of the passages 238, the user can quickly assemble the paint roller 200 to any of the available angular orientations/rotational positions.

The paint roller of the present invention provides a marked improvement over the standard paint roller design. By providing a user with the ability to easily change orientation of an attached tubular paint applicator relative to the handle, a wide variety of new applications for the paint roller are now available. For example, a simple rotation of the shaft (and thus the attached paint applicator) relative to the handle facilitates painting a corner. Additionally, selecting a slight forward angle between the tubular paint applicator and the handle allows for expedient painting of elevated surfaces, including ceilings. Finally, the ability to create a forward angle between the tubular paint applicator on the handle results in a more ergonomically correct handling of the paint roller by a user, thus minimizing stress on the user's wrist, arm and shoulder.

Although the present invention has been described with reference to preferred embodiments, workers skilled in the art that changes may be made in form and detail without departing from the spirit and scope of the invention. For example, the paint roller of the present invention has been described as relating to a standard size. It should be recognized, however, that the present invention can be utilized with any sized paint roller. In this regard, the tube receiving frame is sized according to a length and inner diameter of the tubular paint applicator. In this same respect, because the paint roller allows for a relatively full range of movement of the shaft relative to the handle, it may not be necessary to incorporate the standard U-shaped shaft design. In other words, any of a number of different shapes and configurations are available.

What is claimed is:

1. A paint roller apparatus for use with a tubular paint applicator, the apparatus comprising:

a shaft defining a first end and a second end;

a tube-receiving frame rotatably attached to the second end;

a handle including a leading section defining:

a plurality of shaft-receiving passages each extending from a respective opening in the leading section, each of the passages being sized to slidably receive the first end of the shaft, a bore extending from a side face of the handle in a generally perpendicular fashion relative to an axis of each of the passages, wherein the bore intersects each of the passages; and a connector including a shank sized for placement within the bore;

wherein the paint roller apparatus is adapted such that upon insertion of the first end of the shaft into one of the passages, the shaft is selectively locked relative to the handle via advancement of the shank within the bore in a generally perpendicular fashion relative to an axis of the passage within which the first end of the shaft is received.

2. The apparatus of claim 1, wherein the leading section forms three of the shaft-receiving passages.

3. The apparatus of claim 1, wherein the plurality of passages are co-planar.

4. The apparatus of claim 1, wherein the plurality of passages extend in a non-parallel fashion.

5. The apparatus of claim 1, wherein the leading section defines a first top face portion and a second top face portion, the top face portions defining non-parallel planes, and further wherein a first one of the passages extends from an opening in the first top face portion and a second one of the passages extends from an opening in the second top face portion.

6. The apparatus of claim 5, wherein the leading section further defines a third top face portion extending in a plane that is non-parallel relative to planes of the first and second top face portions, and further wherein a third one of the passages extends from an opening in the third top face portion.

7. The apparatus of claim 6, wherein the first, second, and third passages extend in a perpendicular fashion relative to the first, second, and third top face portions, respectively.

8. The apparatus of claim 6, wherein the second and third top face portions extend from opposing sides of the first top face portion and further wherein, an angle defined by the first and second top face portions is different from an angle defined by the first and third top face portions.

9. The apparatus of claim 8, wherein an angle between the first and second top face portions is approximately 210° and an angle between the first and third top face portions is approximately 240°.

10. The apparatus of claim 1, wherein the passages are each adapted to allow a plurality of rotational orientations of the shaft relative to the handle.

11. The apparatus of claim 1, wherein the first end of the shaft defines a plurality of flattened surfaces.

12. The apparatus of claim 1, wherein the first end of the shaft defines a square in transverse cross-section.

13. The apparatus of claim 1, wherein the shank terminates in an engagement end adapted to contact the first end of the shaft in the locked position.

14. The apparatus of claim 1, wherein the shank includes an exterior thread adapted to be threadably engaged within the bore.

15. The apparatus of claim 14, wherein the bore defines interior threads adapted to threadably engage the shank.

16. The apparatus of claim 1, wherein each of the passages have a uniform diameter extending between opposing ends, and further wherein the bore intersects each of the passages along a length thereof, spaced from the respective opposing ends.

17. A method of assembling a paint roller apparatus, the method comprising:

providing a shaft defining a first end and a second end, a tube-receiving frame being rotatably attached to the second end;

providing a handle including a leading section defining a plurality of shaft-receiving passages, each extending from respective openings in the handle and sized to receive the first end of the shaft, and a bore extending from a side face of the leading section and intersecting each of the passages;

inserting the first end of the shaft into one of the passages;

positioning the shaft at a desired rotational position relative to the handle; and advancing a portion of the connector within the bore in a direction non-parallel with an axis of the passage within which the shaft is inserted to lock the shaft relative to the handle.

18. The method of claim 17, further comprising:

selecting one of four available rotational orientations of the shaft relative to the handle.

19. A paint roller apparatus for use with a tubular paint applicator, the apparatus comprising:

a shaft defining a first end and a second end;

a tube-receiving frame rotatably attached to the second end;

a handle including a leading section defining:

a first top face portion, a second top face portion, wherein the top face portions define non-parallel planes, a first shaft-receiving passage extending from an opening in the first top face portion, a second shaft-receiving passage extending from an opening in the second top face portion, wherein the passages are each sized to slidably receive the first end of the shaft, a bore extending from a side face of the handle in a generally perpendicular fashion relative to an axis of at least one of the passages, wherein the bore intersects each of the passages; and a connector including a shank sized for placement within the bore;

wherein the paint roller apparatus is adapted such that upon insertion of the first end of the shaft into one of the passages, the shaft is selectively locked relative to the handle via advancement of the shank within the bore.

20. The apparatus of claim 19, wherein the leading section further defines a third top face portion extending in a plane that is non-parallel relative to planes of the first and second top face portions, and further wherein a third passage extends from an opening in the third top face portion.

* * * * *